US005119986A

United States Patent [19]

Kobilarcik et al.

[11] Patent Number: 5,119,986

[45] Date of Patent: Jun. 9, 1992

[54] MAILBOX ASSEMBLY

[75] Inventors: Albert T. Kobilarcik; John C. Weyer, Sr., both of Wooster, Ohio

[73] Assignee: Rubbermaid Incorporated, Wooster, Ohio

[21] Appl. No.: 742,805

[22] Filed: Aug. 9, 1991

[51] Int. Cl.[5] ..... A65D 91/00

[52] U.S. Cl. ..... 232/35; 232/17

[58] Field of Search ..... 232/34, 35, 37, 38, 232/17

[56] References Cited

U.S. PATENT DOCUMENTS

| | | | |
|---|---|---|---|
| 792,133 | 6/1905 | Hunt | 232/35 |
| 1,292,050 | 1/1919 | Raney | 232/35 |
| 2,551,915 | 5/1951 | Turner | 232/34 |
| 2,639,856 | 5/1953 | Thomas | 232/35 |
| 2,687,846 | 8/1954 | Chrisman | 232/35 |
| 2,852,185 | 9/1958 | Stouten | 232/35 |
| 2,905,378 | 9/1959 | Cox et al. | 232/35 |
| 2,927,727 | 3/1960 | Kreider | 232/35 |
| 2,988,268 | 6/1961 | Mioduski | 232/35 |
| 3,143,287 | 8/1964 | Holt | 232/35 |
| 3,294,057 | 12/1966 | Feil | 116/132 |
| 3,498,256 | 3/1970 | Hebal | 116/132 |
| 3,602,424 | 8/1971 | Raulston | 232/35 |
| 3,648,924 | 3/1972 | Burns | 232/35 |
| 3,815,811 | 6/1974 | Harmon | 232/35 |
| 3,960,317 | 6/1976 | Clement | 232/35 |
| 4,005,816 | 2/1977 | Malik | 232/35 |
| 4,113,170 | 9/1978 | Hunsicker | 232/35 |
| 4,147,292 | 4/1979 | Fisher | 232/35 |
| 4,151,949 | 5/1979 | Huebener | 232/34 |
| 4,290,549 | 9/1981 | Getz | 232/35 |
| 4,552,302 | 11/1985 | Rung | 232/35 |
| 4,570,846 | 2/1986 | Morgrey | 232/35 |
| 4,685,612 | 8/1987 | Rascov | 232/35 |
| 4,706,880 | 11/1987 | Peters | 232/35 |
| 4,720,042 | 1/1988 | Tapy | 232/35 |
| 4,728,028 | 3/1988 | Barnes et al. | 232/35 |
| 4,738,392 | 4/1988 | Kovacs | 232/34 |
| 4,752,030 | 6/1988 | Witt | 232/35 |
| 4,753,386 | 6/1988 | Phillion | 232/43.1 |
| 4,759,496 | 7/1988 | Swick | 232/35 |
| 4,771,941 | 9/1988 | Bowman et al. | 232/35 |
| 4,778,103 | 10/1988 | Nelsen | 232/34 |
| 4,793,552 | 12/1988 | Revels | 232/35 |
| 4,805,834 | 2/1989 | Saba | 232/34 |
| 4,811,895 | 3/1989 | Reinebach | 232/35 |
| 4,821,953 | 4/1989 | Poloha | 232/35 |
| 4,836,441 | 6/1989 | Crider | 232/35 |
| 4,860,949 | 8/1989 | Moore | 232/35 |
| 4,986,467 | 1/1991 | Bibbee | 232/34 |
| 5,040,723 | 8/1991 | Kelley | 232/35 |

*Primary Examiner*—Renee S. Luebke
*Assistant Examiner*—F. Suether
*Attorney, Agent, or Firm*—Richard B. O'Planick

[57] ABSTRACT

A mailbox assembly is disclosed comprising a mailbox body having a roof, parallel sidewalls (6), and a front door (4). The assembly further includes a flag housing assembly (8) for outgoing mail indication, attachable to one side of the mailbox body, and a second housing assembly (10) attachable to one side of the mailbox body for incoming mail indication. The flag assembly (10) is pivotally attachable to either of the mailbox body sidewalls, at the election and preference of the user, and comprises actuation means (40) responsive to pivotal opening of the mailbox door, and a pivot post member (42) for insertion through co-aligned apertures in the mailbox body and door, whereby pivotally attaching the flag housing assembly to one of the mailbox sides and pivotally attaching the door to the mailbox body. The flag assembly further includes spring means (52) for pressuring the flag housing body against the mailbox side, and registrable flag detent and rib means (82, 86) for locking the flag arm (36) into first and second positions.

34 Claims, 6 Drawing Sheets

MAILBOX ASSEMBLY

BACKGROUND OF THE INVENTION

1. Field of the Invention

The present invention relates to mailbox assemblies in general, and in particular to mailboxes having a mail delivery indicator flag by which a remote owner may detect the delivery of mail.

2. The Prior Art

Mailboxes for rural delivery of mail commonly have two indicator flags, each serving a different purpose. The first flag is for indicating to the mail deliverer that mail is present in the mailbox for pick-up; the second flag is for indicating to the mail recipient, from a remote viewing location, that mail has been delivered.

There have been many prior art attempts to provide mailboxes with flag indicators which are actuated by the door of the mailbox, for the purpose of indicating the delivery of mail. One approach, typified by U.S. Pat. No. 2,687,846, teaches a flag member which tilts upon actuation of the front mailbox door. A second approach, embodied in U.S. Pat. No. 4,147,282, provides a pivotal flag component, which pivots from an upright position to a down position whenever the mailbox door is opened. Yet nother approach, represented by U.S. Pat. No. 3,648,924, contemplates a flag arm which is freed to pivot downward upon the opening of the mailbox door. Other mechanisms which address the problem are set forth in U.S. Pat. Nos. 4,836,441; 4,759,496; 4,778,103; and 4,811,895.

While the aforementioned patented articles achieve the intended objective to varying degrees, all have certain shortcomings which prevent them from representing an ideal solution. Many of the indicator mechanisms are complex and expensive to manufacture; some are dependent on maintaining a precise structural relationship between operational components in order to insure proper operation; and others are less than optimal in the visibility of the indicator flag when put to use.

Moreover, prior art indicator mechanisms are fixed to one specific side of the mailbox and cannot be relocated to suit the various viewing angles which occur in use. Because of the fixed flag location, the visibility of the flag in certain situations is reduced. Also, the flag indicator mechanisms in the prior art lack a positive registration feature which secures the flag member in its proper position. They are thus susceptible to malfunction from external factors such as wind.

SUMMARY OF THE INVENTION

The present invention addresses the above-described shortcomings in the prior art, by providing an improved mailbox assembly having mail delivery indicating capability. The mailbox assembly includes a mailbox body and downwardly pivoting forward door. The flag assembly provided with the mailbox can by attached to either side, at the option of the user; wherever the flag can be viewed to best advantage for that application.

The flag assembly further is utilized to provide the door with its pivot attachment to the mailbox body, whereby adding to the economy of the assembly. The flag assembly comprises a housing assembly which pivotally attaches to one or the other sidewalls of the mailbox body, proximate the forward door. The housing assembly includes an internal cavity, a plug member seated within the cavity and providing a pivot post projection directed toward the mailbox body, and a retainer member which encloses an inward side of the cavity. A spring ring is also provided within the housing assembly cavity, between the retainer member and the head of the plug member.

The retainer member and spring ring have central apertures through which the pivot post projects. Each side of the mailbox body and door have co-aligned apertures which receive the pivot post therethrough as well. An inward end of the pivot post has a locking flange which snaps over a surface surrounding the door aperture, whereby placing the spring ring in compression, and pressuring the retainer member against the side of the mailbox. The inwardly directed side of the retainer member has spaced apart detents adapted to engage a projection formed in the mailbox body side as the housing assembly rotates between a "down" position and an "up" position, thus creating positive registration in both positions.

The housing assembly is further provided with a tab projection extending from the housing to a position forward of the mailbox door, whereby, upon opening the mailbox door, the door engages the tab projection, and initiates pivotal movement of the housing assembly and the flag arm attached thereto.

A secondary assembly, substantially similar to the flag assembly, is also provided for attachment to the mailbox side opposite to the flag assembly. The secondary assembly substitutes a cap member for the housing member of the flag assembly, and provides the pivot post for the opposite side of the mailbox door. The user can select which side of the mailbox to put the flag assembly, depending on the visibility constraints of the mailbox site. The mailbox assembly can be shipped disassembled in kit form and subsequently assembled by the user without tools, to facilitate the aforementioned optional positionment of the flag assembly.

Accordingly, it is an objective of the present invention to provide a mailbox assembly which is inexpensive to manufacture, and readily assembled and utilized.

A further objective is to provide a mailbox assembly which requires no tools for assembly.

Still a further objective is to provide a mailbox assembly which affords the user the option of alternate sides on which to locate the indicator flag assembly.

Yet a further objective is to provide a mailbox assembly including a mail delivery indicator flag assembly which has positive registration detent means in the down and up conditions.

A further objective is to provide an all plastic mailbox assembly which includes positive spring bias means for influencing a flag assembly against the mailbox body.

Still a further objective is to provide an all plastic mailbox assembly which is composed of inexpensive, plastics material.

These, and other, objectives, which will be apparent to those skilled in the art, are achieved by a preferred embodiment which is described in detail below, and which is illustrated by the accompanying drawings.

BRIEF DESCRIPTION OF THE ACCOMPANYING DRAWINGS

DESCRIPTION OF THE PREFERRED EMBODIMENT

Figure 1:
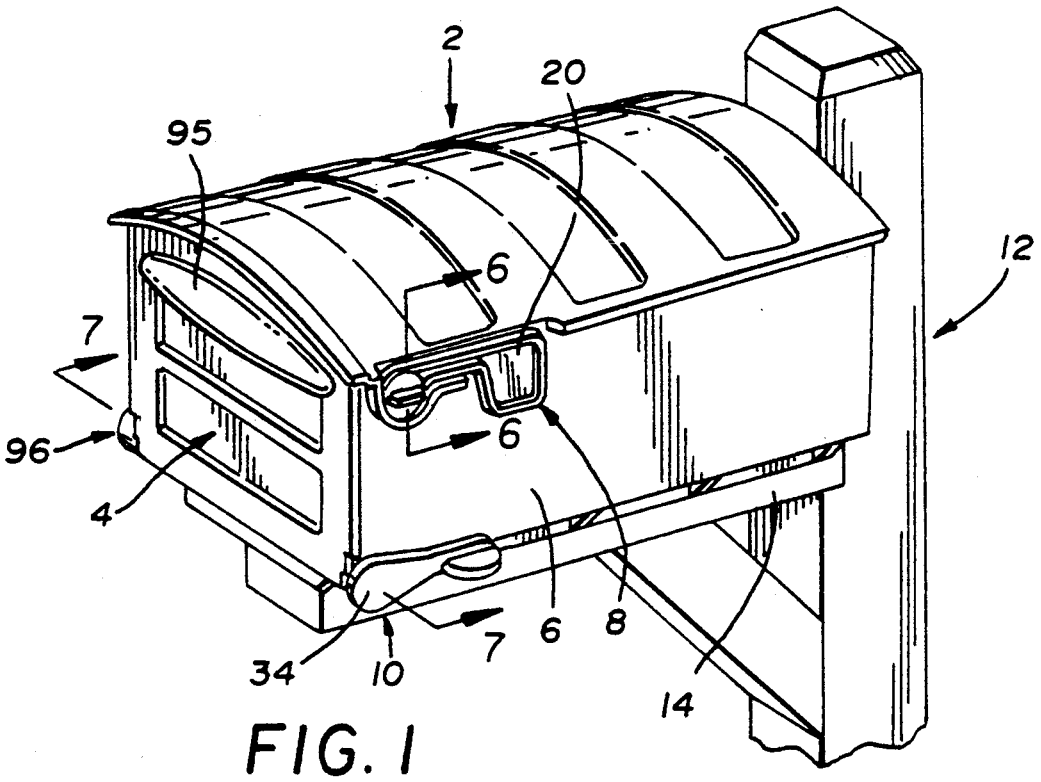
FIG. 1 is an assembled perspective view of the subject mailbox assembly.
Figure 3:
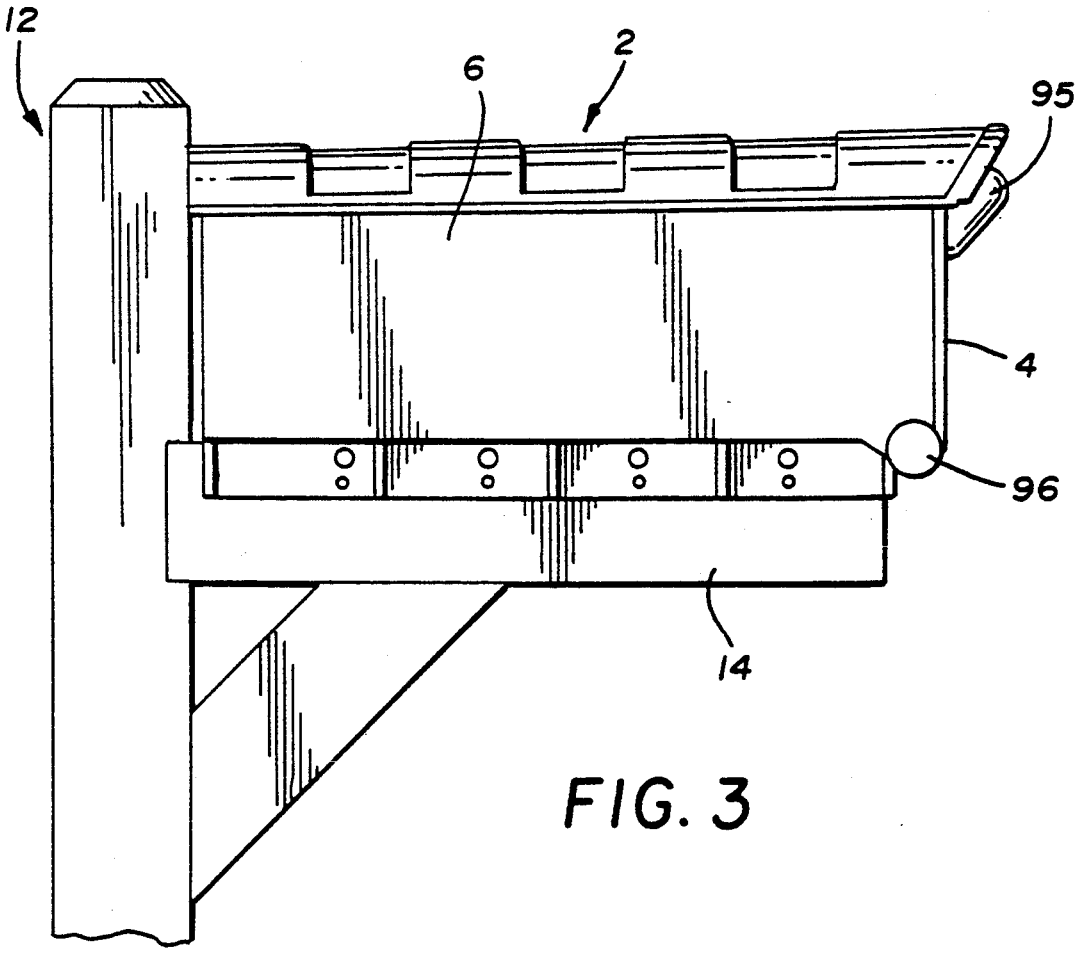
FIG. 3 is a side elevation view of the mailbox assembly.

Referring first to FIG. 1, the subject mailbox assembly 2 is shown to comprise a rectangular body, including a front door 4, and longitudinal sides 6. An outgoing mail indicator flag assembly 8 is attached to one of the sides 6, proximate a top edge, and an incoming mail indicator flag assembly 10 is attached to the side 6 proximate a lower edge, and generally adjacent the front door 4. As explained in greater detail below, the flag assembly 10 can attach to the opposite side of the mailbox in those applications where the visibility of the flag in assembly 10 would thereby be enhanced. Pursuant to convention, the mailbox assembly 2 is mounted to a vertical post 12, and specifically rests upon a horizontal support arm 14 extending perpendicularly from the post 12.

It will be appreciated that the purpose of the flag assemblies 8,10 is as follows. The flag assembly 8 is pivoted into a vertical orientation by the user whenever outgoing mail is deposited in the mailbox for pick-up. The upright flag indicates to the mailperson that mail is present for withdrawal. The flag assembly 10 is pivoted by the opening of the door 4, and thereby, in the upright condition, indicates that a delivery of mail has occurred.

Figure 2:
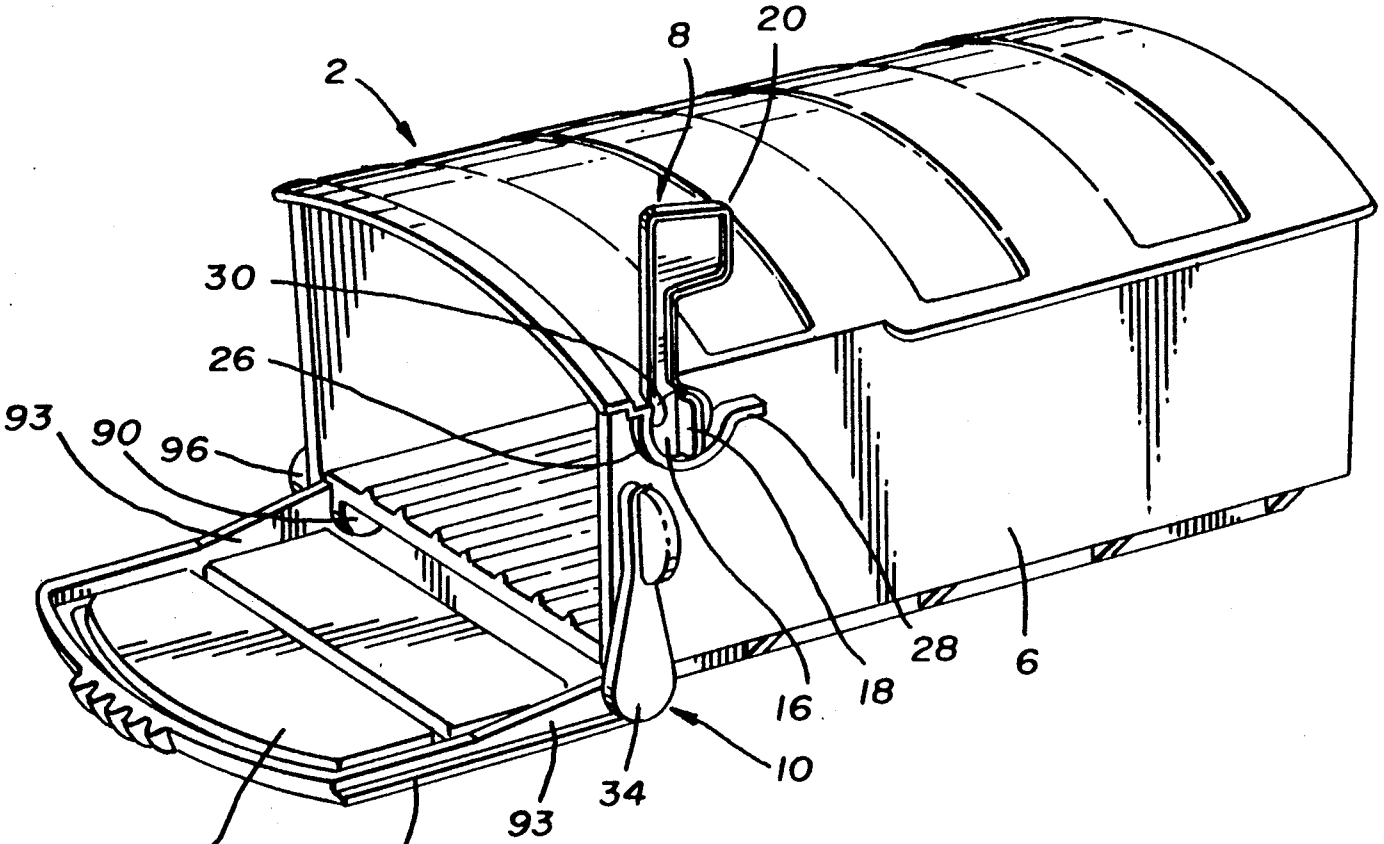
FIG. 2 is a perspective view of the subject mailbox assembly shown with the door open and both flags in the raised position.
Figure 4:
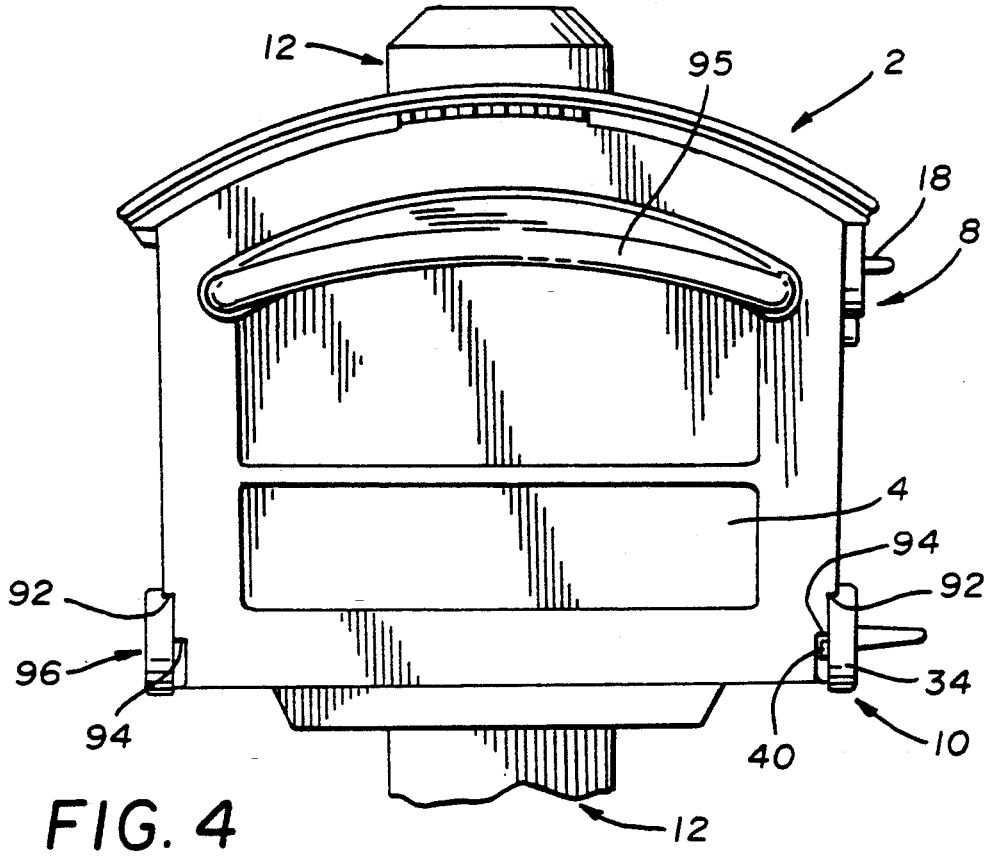
FIG. 4 is a front elevation view of the mailbox assembly.
Figure 6:
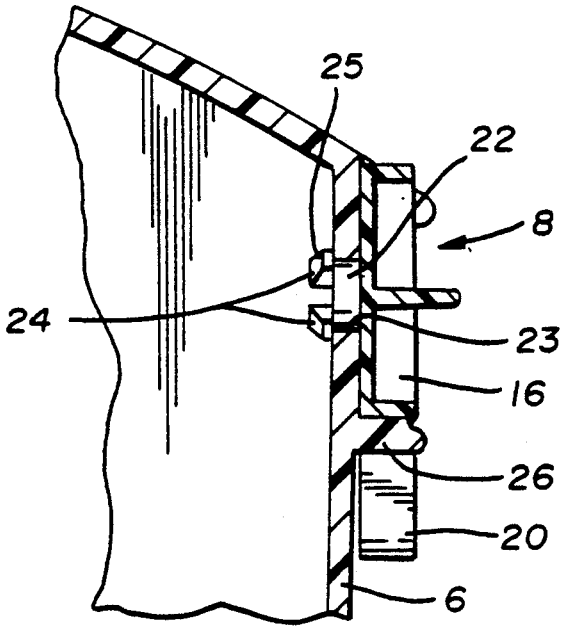
FIG. 6 is a sectional view through the top flag assembly, taken along the line 6—6 of FIG. 1.

Referring now to FIGS. 2 and 6, the upper flag assembly is seen to comprise a unitarily molded plug member 16, having a gripping flange 18 in an outward facing surface, and an elongate flag arm 20 extending substantially parallel to the mailbox sidewall. The plug member 16 has a neck portion which projects through an appropriately sized aperture 23 in the mailbox sidewall 6, and separated resilient tines 24 at an inward end. The tines 24 are provided with outward projecting lugs 25, which engage over an inward surface of the mailbox defining the aperture 23. So assembled, plug member 16 rotates and repositions the flag arm 20 from a horizontal, down position, to a vertical, up, position shown in FIG. 2.

The plug member 16 is received into a well defined by a serpentine socket flange 26, integrally molded with the mailbox sidewall 6. The socket flange comprises a horizontal, rearwardly disposed, ledge portion 28, and a vertical, forwardly disposed, portion 30. It will readily be appreciated that the flag arm 20 rests upon the ledge portion 28 in the down condition, and rotates upward into a vertical orientation to indicate to the deliveryman, the presence of mail in the box.

Figure 7:
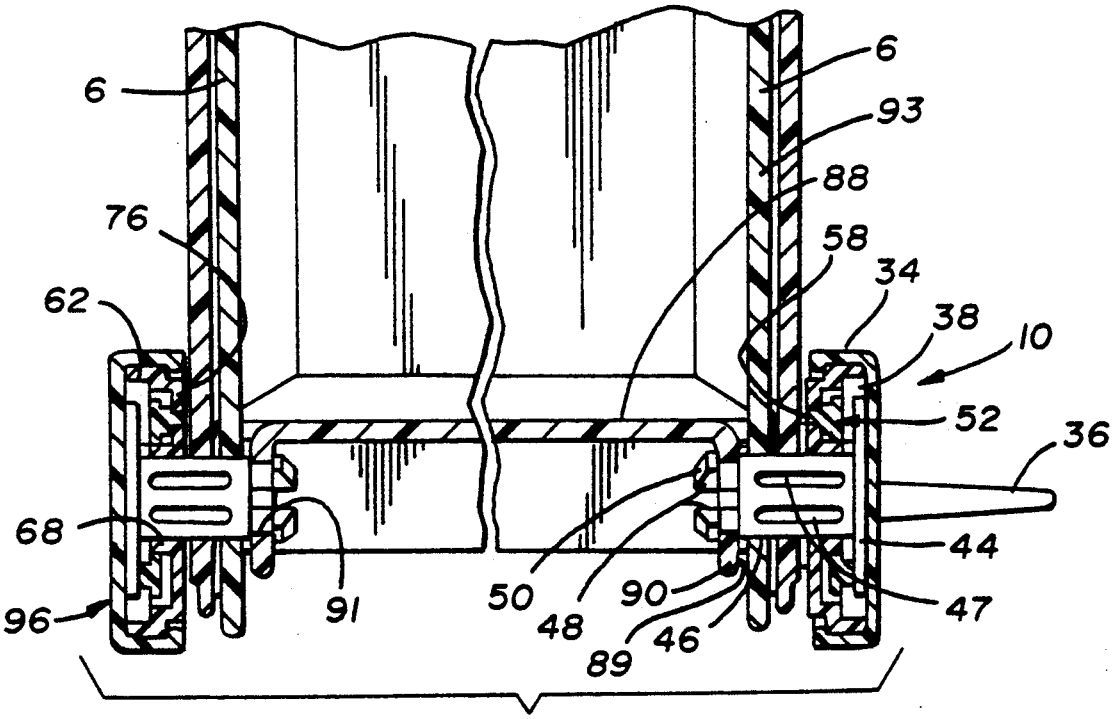
FIG. 7 is a sectional view through the lower portion of the mailbox assembly, including the lower flag assembly, taken along the line 7—7 of FIG. 1.
Figure 8:
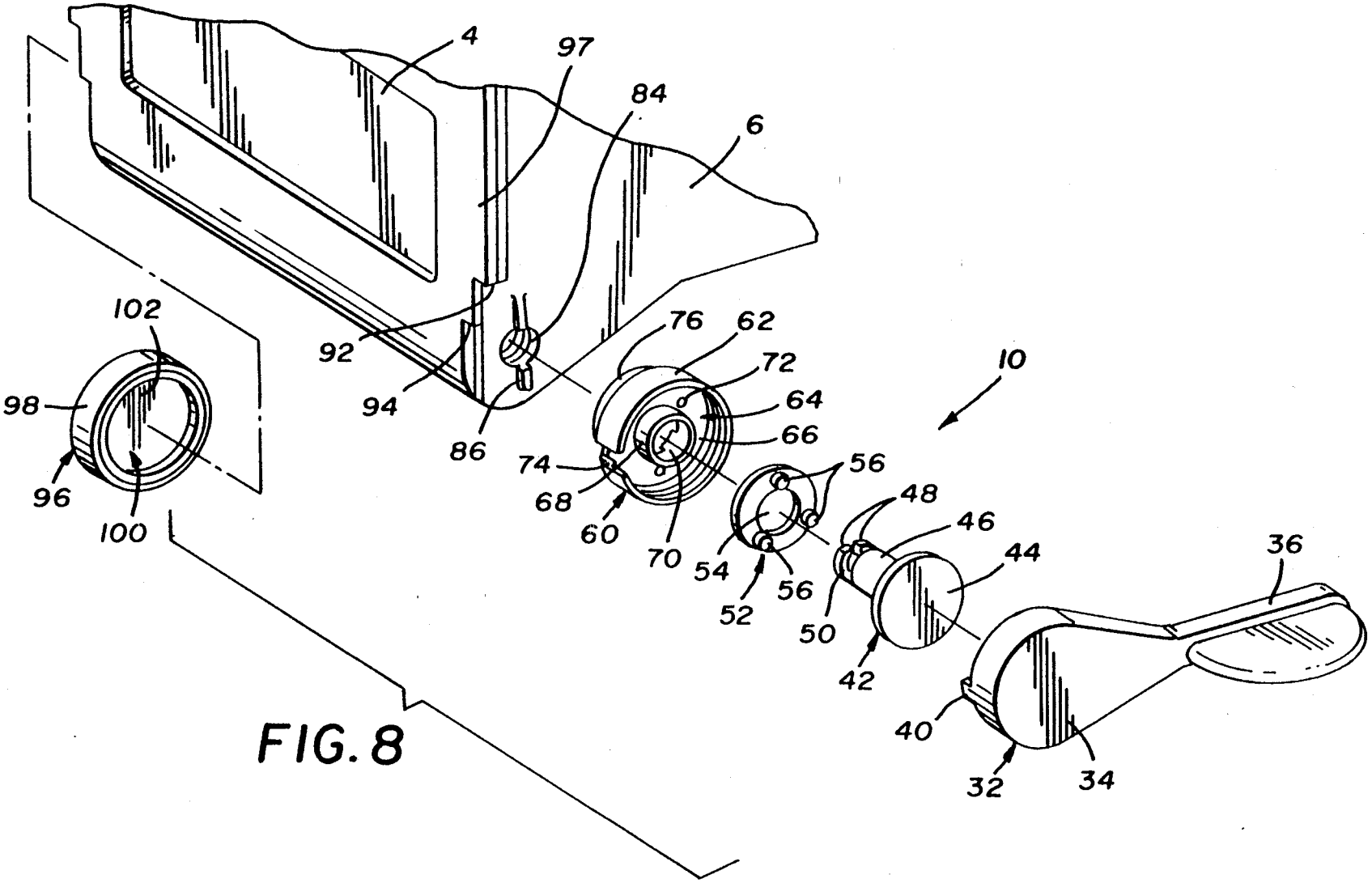
FIG. 8 is an exploded perspective view of the lower flag assembly.

The incoming mail indicator flag assembly 10, as illustrated in FIGS. 2, 7, and 8, includes a flag component 32, comprising a housing body 34, and a flag arm 36. The housing body 34 is generally circular at the base end, and has a cylindrical internal cavity 38 formed therein, opening toward the mailbox side 6. A tab projection 40 extends outwardly from the body 34 toward and forward of the mailbox door 4. The assembly further comprises a plug member 42, having a circular head portion 44, an intermediate shank portion 46, and two spaced apart tines 48 at a remote end. As shown, the plug member shank portion 46 incorporates spaced apart slots 47 extending longitudinally along one side, to facilitate molding of the part and to reduce the part's material content. Each of the tines 48 is formed having an outwardly projecting flange 50 at a terminal end.

A spring member 52, formed in the shape of a ring, further is included in assembly 10. The spring member is molded of highly resilient plastics material, for example commercially available plastic sold under the name ACETAL by DuPont Corporation. The spring member 52 has a central through hole 54, and a series of spaced-apart post projections 56 positioned about hole 54. A series of locating protrusions 58 are positioned about the hole 54 on the underside of the spring member 52, and project outward therefrom.

A retainer member 60 is provided in the assembly 10, of generally cylindrical shape. A cavity 64 extends into member 60, defined by cylindrical sidewalls 62. Cavity 64 terminates at a bottom floor 66 from which a cylindrical boss 68 extends upward, centered within cavity 64. A through bore 70 extends through the boss 68 and the member 60 on the center axis. Three apertures 72 extend through the floor 66 of the cavity 64, positioned to correspond with the locating protrusions 58 in the underside of the spring member 52. Extending down the side 62 is a slot 74, dimensioned to accomodatively receive the tab 40 of the flag component housing body 34.

Figure 10:
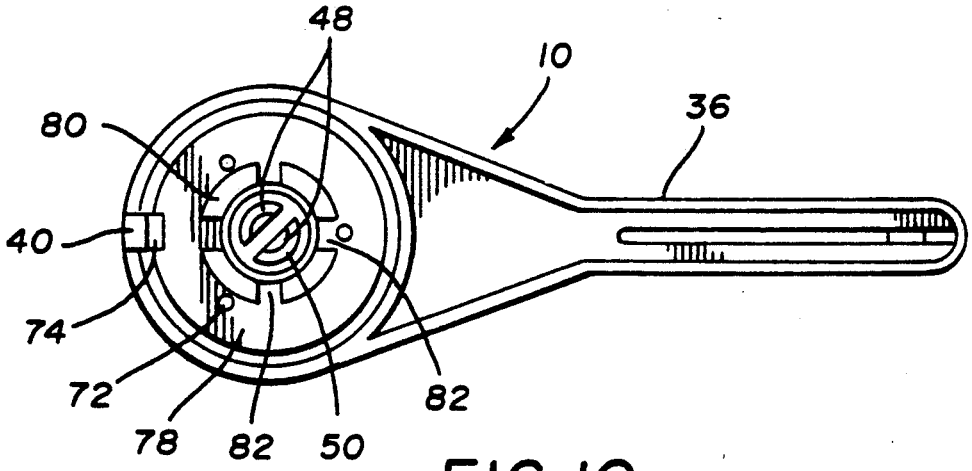
FIG. 10 is a side elevation view of the assembled lower flag assembly.

The member 60 is formed having a stepped-in lower portion 76. As best viewed in FIG. 10, a lower surface 78 of member 60 is formed to provide an annular flange 80 extending around the periphery of the through-bore 70. Indexing detents 80 are formed within the annular flange at ninety degree intervals.

As shown in FIGS. 2, 7, and 8, the mailbox side 6 has an aperture 84 therethrough. Positioned adjacent to the aperture 84 and extending vertically is an indexing rib 86.

Referring to FIGS. 1, 2, 7, and 8, the mailbox is formed integrally, by conventional molding of plastics material, to have a bottom floor 88. An inward bottom flange 90 is formed to the inside, and spaced apart from, the lower portion of the mailbox side 6. Together, the lower portion of the mailbox side and the flange 90 define a vertical slot 89 on each side of the mailbox. The flange 90 is provided with a through-aperture 91 which co-aligns with the aperture 84 in the mailbox side 6.

The mailbox door is manufactured of conventional plastics material, by injection molding. Each side of the door 4 is provided with a series of stepped edges 92 and 94 at the bottom door corners. The inside of the door, as best shown by FIGS. 2 and 7, has elongate inside flanges 93 along each side, and elongate outer door flanges 97. Flanges 93 are intended to fit between sides 6 and flanges 90 of the mailbox body and have appropriately positioned apertures in the lower end to align with apertures 84 and 91 of the mailbox body.

The mailbox is intended to be sold to the end user in a partially disassembled condition. The mailbox body is unitarily molded, as is the door 4, and flag assembly componentry, of a suitably hard plastic material such as polypropylene. The lone exception is the spring member 52, which is molded from a plastic having high spring properties, such as Acetal.

The user receives the mailbox assembly with the door attached to the body, by way of two sets of components 42, 52, 60. The sides of the mailbox body and door are identically formed, having the flanges and co-aligned apertures aforementioned. One flag component 32 is provided, for one side of the mailbox, and a substitute cap member 96 is provided for the other side. Cap member 96 has an internal cavity 100 formed by cylindrical sidewalls 98, terminating at a bottom floor 102. It will be appreciated that the size and shape of the cap member 96, and cavity 100, substantially replicate the size and shape of the flag housing body 34 and cavity 38, respectively.

The user is to determine which side of the mailbox body to mount the flag assembly 32, based upon the particular location of the mailbox relative to the customary position from which the user views the mailbox. By previous assembly by the manufacturer, the head portion 44 of the plug member 42 is inserted into the housing body cavity 38, and spring member 53 is inserted into the cavity 64 of retainer member 60, over the cylindrical boss 68. It will be appreciated that the locating protrusions 58 of the spring member 53 underside register within the spring locating apertures 72 of the retainer member 60.

The shank portion 46 of the plug member 42 is then inserted through the apertures 54 (of spring member 52), and 70 (of retainer member 60), as the retainer member 60 is inserted into cavity 38 of housing body 34. The tab 40 is thereby positioned to extend through the slot 74 of the retainer member 60. The rim of the housing body 34, as best shown by FIGS. 8 and 7, snaps over the sidewall 62 of the retainer member 60, whereby securing the assembly together.

The semi-completed flag assembly 10 is then affixed to the preferred side of the mailbox body. As shown, the length of the plug member is sufficient to extend through aligned apertures of the mailbox side 6, the door flange 93, and the bottom floor flange 90. When insertion is complete, the tine flanges 50 snap over the inside surface of the floor flange 90. The spring is compressed between the plug member cap 44 and the floor 66 of the retainer member 60, and the annular flange 80 on the underside of the retainer member 60 (FIGS. 7 and 10) is pressured thereby against the mailbox side 6. Consequently, the flag assembly 10 is firmly forced against the mailbox side 6, yet is free to pivot about a pivot axis which extends through the plug member shank portion 46.

As previously mentioned, the mailbox is preferably sold with the door pivotally attached by the two sets of assemblies of components 42, 52, and 60. The user snaps the flag component 32 over the assembly on the appropriate side, and the substitute cap member 96 over the other assembly, subsequent to purchase.

Also, it will be appreciated that the pivot axis of the flag assembly is shared by the mailbox door 4, which is pivotally secured to the mailbox body by the plug member tines 48. The flag assembly 10 accordingly serves two purposes; first, it provides an indicator flag to automatically indicate when mail has been delivered to the mailbox, and secondly, as means to pivotally attach a corner of the mailbox door to the mailbox.

Figure 5:
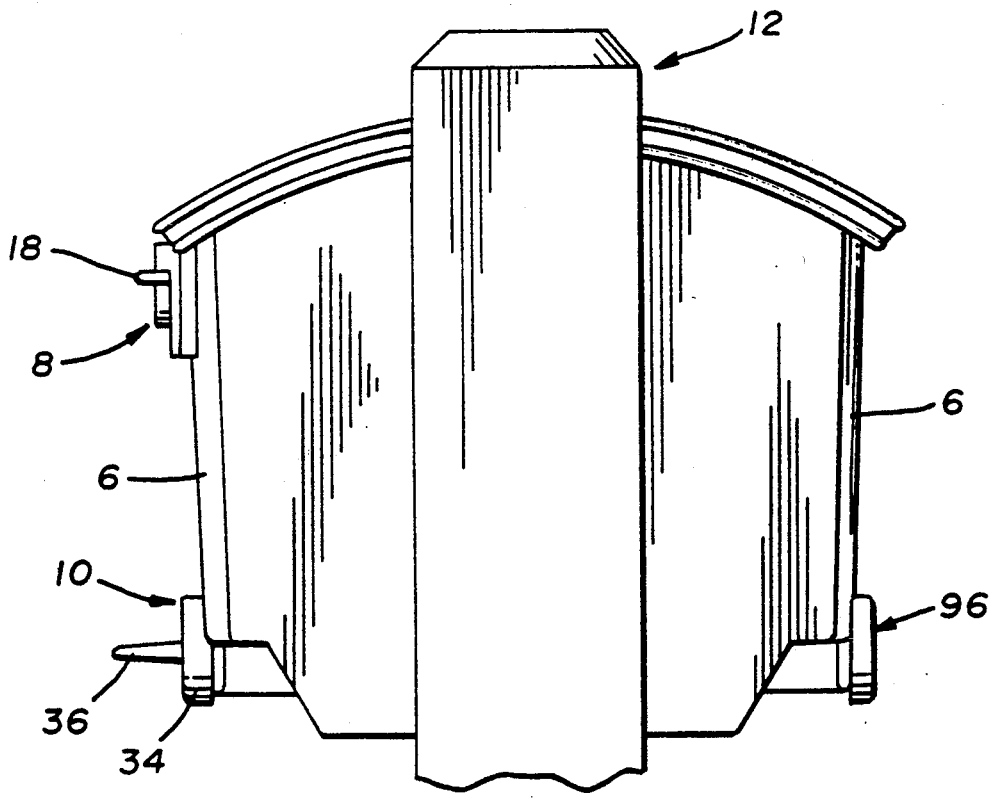
FIG. 5 is a rear elevation view of the mailbox assembly.
Figure 9:
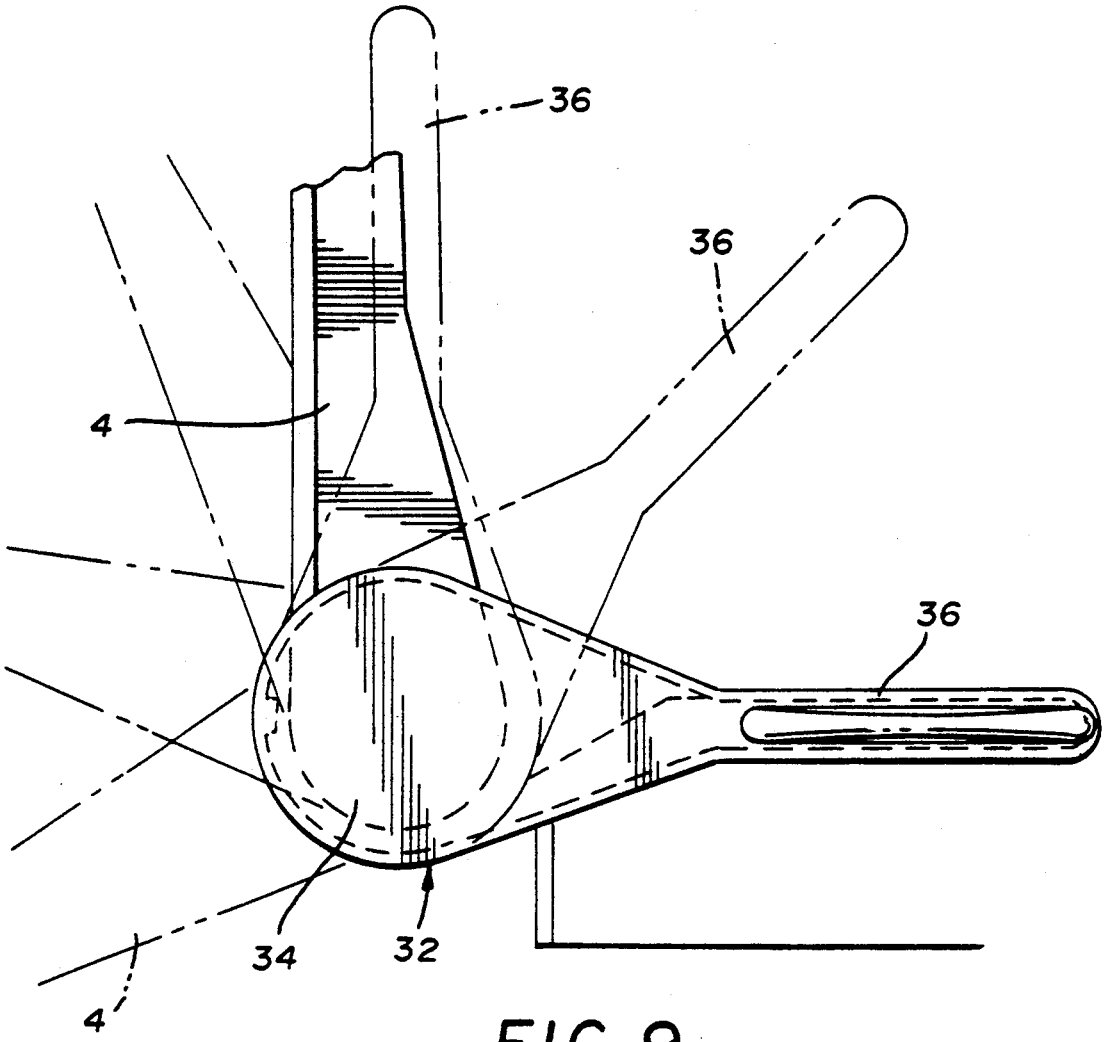
FIG. 9 is a side elevation view of the lower flag assembly, showing pivotal movement between a lower and upper position.

As shown in FIGS. 5 and 8, the tab 40 of the flag assembly 10 is positioned forward of, and adjacent to, the corner edge 94 of the door 4 when the flag assembly is attached to the mailbox. Both sides of the door 4 provide a corner edge 94 in order to afford the user the option of placing the flag assembly on either side. As illustrated in FIG. 9, as the door is opened by the deliveryman, to deposit mail, the edge 94 catches tab 40 and initiates pivotal rotation of the housing body 34. When the door has been fully opened, flag arm 36 will have been pivoted from a first, horizontal position, to an upright second position. As the door is then closed, the flag arm 36 remains in the upright condition so as to indicate to a remote viewer, the presence of mail. After the mail is removed, the flag arm 36 can be manually dropped back into its horizontal first position by the user.

An indexing rib 86 is present on both sides of the mailbox, although only one is shown in FIG. 8. The rib 86 bears against the annular flange 80 and is pressured thereagainst by the operation of spring 52, described previously. The pivotal rotation of the housing body 34 pivots the retainer member 60 integrally therewith, until the flag reaches its upright position. The indexing detents 82 of the retainer member 60 are spaced ninety degrees apart, such that the indexing rib 86 enters one of the detents 82 when the flag is in the horizontal first position and again when the flag reaches its vertical second position. The pressure exerted by spring 52 against the retainer member 60, and in turn against the mailbox side 6, insures a positive registration of the indexing rib 86 within the detents 82.

The subject invention is intended to be sold in the partially disassembled condition, but need not. In the preferred embodiment, the mailbox is sold in kit form, with the door attached, but components 32 and 96 in loose form. The kit is provided with two sets of pivot post assemblies; the first being the flag assembly 10 described above, and the second being an assembly identical to the flag assembly 10 but with cap member 96 instead of the flag component 32. Alternatively, however, if so desired, two of the flag assemblies 10 may be used, one for each side of the mailbox. In the alternative case, then, two indicator flags would be simultaneously raised with the opening of the door. It will be readily understood that the cap member 96 is identical to the flag component body 34 in dimension and internal configuration, suitable to receive and assemble a second set of components 42, 52, and 60, and thereafter to assemble to the mailbox side opposite to that side selected to receive the flag assembly 10.

It will be appreciated that the mailbox body, including the sidewalls, floor, and roof, are intended to be unitarily molded of conventional plastic material, in the preferred embodiment. The other components, such as the door, flag assembly and cap assembly components, can likewise be so manufactured. A suitable material for the manufacture of such components is polypropylene. The spring member 52 can be molded of suitable plastic material having a high spring property, such as Acetal.

The assembly of the mailbox components and their attachment subsequently to the mailbox body can be effected without the need for tools. The dual functions served by the flag assembly, i.e. as an indicator as well as pivot attachment means for the door, enhances the utility of the subject assembly by reducing its cost. The inexpensive to manufacture components likewise minimize the cost of the assembly. Finally, the positive registration detent structure, under the influence of the spring member, makes the flag indicator relatively foolproof. The flag will remain in the down or up positions until pivoted intentionally out of those positions, because the registration rib of the mailbox side is spring biased into the appropriate detent slot. Therefore, external influences on the flag arm, such as wind, will not move the flag from its proper position.

While the above describes the preferred embodiment, the subject invention is not to be so restricted. Other embodiments, which will be apparent to those skilled in the art, and which utilize the teachings herein set forth, are intended to be within the scope and spirit of the present invention.

We claim:

1. A flag assembly for attachment to a mailbox body or the like, comprising:

housing assembly means pivotally attachable to a sidewall of the mailbox body, proximate a forwardly located mailbox door; the housing assembly having sidewalls, and detent recess means directed toward the mailbox body;

a flag arm attached to the housing assembly means and extending outwardly therefrom substantially parallel to the mailbox body;

spring means for constantly pressing the housing assembly means against the mailbox sidewall;

tab means extending from the housing assembly means to a position forward of the mailbox door, whereby, upon opening the mailbox door, the door engages said tab means and initiates pivotal movement of the housing assembly means and flag arm;

rib registration means extending outwardly from the mailbox sidewall and adapted to enter the detent recess means when the flag arm pivots to a terminal second position.

2. An assembly according to claim 1, wherein said housing means being optionally attachable to an opposite side of said mailbox body according to a user's preference.

3. An assembly according to claim 1, wherein said housing assembly means comprising pivot post means for pivotally attaching the housing means to said mailbox sidewall, and for pivotally attaching the mailbox door to the mailbox body.

4. An assembly according to claim 3, wherein said housing assembly means comprising:

a housing body defined by said housing assembly means sidewalls, and having an internal cavity opening toward the mailbox body and adapted to receive the pivot post means therein;

a retainer member for enclosing said housing body cavity and having aperture means for receiving said pivot post means through said retainer member, said mailbox sidewall and said mailbox door having secondary aperture means in co-alignment with said retainer member aperture means and receiving said pivot post means therethrough;

said spring means being located in said housing body cavity between said pivot post means and said retainer member, and said pivot post means having attachment means at an inward end for engaging said mailbox door, whereby compressing said spring member and pressuring said retainer member against said mailbox sidewall.

5. An assembly according to claim 4, wherein said pivot post means comprising a plug member having a head portion residing within said housing body cavity, an intermediate shank portion projecting through said retainer member aperture means and said mailbox sidewall and said mailbox door secondary aperture means; said pivot post attachment means being located at a distal inwardly located end of said shank portion.

6. An assembly according to claim 5, wherein said detent means is located on a surface of said retainer member facing said mailbox side.

7. An assembly according to claim 6, wherein said detent means comprising spaced apart recesses positioned about the periphery of said retainer member aperture means.

8. An assembly according to claim 7, wherein said pivot post attachment means comprising an outwardly directed flange located at said distal inward end of said shank portion, and adapted to abut against an inward surface of said mailbox door.

9. An assembly according to claim 8, said spring means comprising a ring shaped body of resilient plastic material, having spaced apart projections extending outwardly to abut said plug member head portion.

10. A mailbox assembly, comprising:

a front door member having spaced apart sides and co-aligned apertures extending through said sides proximate lower ends thereof and located on a pivot axis:

a mailbox body having spaced apart sidewalls, each said sidewall having a forwardly disposed aperture co-aligning with said door member apertures;

a flag housing assembly pivotally attachable to either of said mailbox body sidewalls, at the election of a user; said flag housing assembly comprising a housing body defined by sidewalls and an interior floor surface, said sidewalls extending normal to said mailbox sidewall and defining with said floor surface an internal cavity opening toward said mailbox body;

a flag arm attached to a housing body sidewall and extending outwardly therefrom substantially parallel to the mailbox body sidewall and normal to said housing body sidewall; and an outwardly projecting pivot post member extending from said housing body internal cavity for insertion through co-aligned mailbox body and front door member apertures, whereby said flag housing assembly body, flag arm, and said front door member sharing a common pivot axis.

11. A mailbox assembly according to claim 10, wherein said assembly comprising a second housing assembly attachable to a sidewall of said mailbox body opposite to said sidewall selected by the user for said flag housing assembly, said second housing assembly comprising:

a housing body defined by sidewalls;

an outwardly projecting pivot post member for insertion through co-aligned mailbox body and front door member apertures, whereby said flag housing assembly pivot post member, said second housing assembly pivot post member, and said front door member pivot sharing a common pivot axis.

12. A mailbox assembly according to claim 10, said flag housing assembly further comprising:

spring means for constantly pressuring said housing assembly against the mailbox sidewall to which said flag housing assembly is attached; and tab means extending from the housing body to a position forward of the mailbox door, whereby, upon opening the mailbox door, the door engages said tab means and initiates pivotal movement of the housing body and flag arm.

13. A mailbox assembly according to claim 12, wherein said housing body having detent recess means directed toward the mailbox body, and said mailbox body having rib registration means extending outwardly from said mailbox body, adapted to enter the detent recess means when the flag arm pivots to a terminal second position.

14. A mailbox assembly according to claim 13, wherein said pivot post member comprising a head portion residing within said housing body cavity, an intermediate shank portion, and a distal end having integral attachment means;

said housing body further comprising a retainer member for enclosing said housing body cavity and having aperture means for receiving said pivot post member shank member therethrough, and said spring means located in said housing body cavity between said pivot post head portion and said retainer member.

15. A mailbox assembly according to claim 14, wherein said spring means comprising a ring-shaped body of resilient plastic material and having spaced-apart projections extending outwardly to abut said pivot post member head portion.

16. A mailbox assembly according to claim 15, wherein said ring-shaped body receiving said pivot post member shank portion therethrough.

17. A mailbox assembly according to claim 16, wherein said attachment means comprising an outwardly directed flange located at said distal end and engaging over an inward surface of said mailbox side defining said mailbox aperture.

18. A mailbox assembly kit, comprising:

a mailbox body, comprising parallel sidewalls, a lid, and a floor cooperatively defining an inner compartment opening toward a front end of said mailbox body, said sidewalls each having an aperture extending therethrough proximate said front end;

a mailbox door member positionable against said front end of said mailbox body, whereby enclosing said compartment, said door member having spaced apart sides and a front panel, said mailbox door sides each having an aperture extending therethrough and co-aligning with a corresponding one of said mailbox body sidewall apertures;

a flag housing assembly pivotally attachable to either one of said mailbox body sidewalls, at the election of a user; said flag housing assembly comprising:

a flag housing body;

indicator flag means attached to said flag housing body for visually indicating the presence of mail within said mailbox body, said flag means comprising an elongate flag stem attached at one end to said housing body and having an outwardly directed flag projection at an opposite end, said flag stem, said flag projection, and said flag housing body being symmetrical about a longitudinal plane of symmetry extending therethrough, whereby said flag body being reversible and adapted for use on either side of a mailbox at the election of a user;

actuation means responsive to pivotal opening of said mailbox door member, for pivoting said flag housing body and said indicator flag means from a first position to a second position; and a pivot post member attached to said flag housing body for insertion through a co-aligned mailbox body and door member aperture, whereby pivotally attaching said door member to said mailbox body.

19. A mailbox assembly kit according to claim 18, wherein said flag housing assembly further comprising spring means for constantly pressuring said flag housing assembly body against said one mailbox body side.

20. A mailbox assembly kit according to claim 19, wherein said flag housing assembly body and said one mailbox body side having engaging registration flange and detent recess means for retaining said flag housing assembly body in said first and said second position.

21. A mailbox assembly kit according to claim 20, said flag housing assembly actuation means comprising a tab projection extending forward of said mailbox door member, and positioned to engage an edge of said door member as said door member is pivoted open, whereby initiating pivotal movement of said flag housing assembly body.

22. A mailbox assembly kit according to claim 18, wherein said kit further comprising a secondary pivot post assembly for insertion through opposite co-aligned mailbox body and door member apertures, whereby pivotally attaching an opposite side of said door member to said mailbox body.

23. A mailbox assembly kit according to claim 18, wherein said flag housing body having sidewalls and an internal floor, said sidewalls extending normal to said mailbox body sidewalls, when assembled thereto, and said indicator flag stem connecting extending normally from a flag housing body sidewall, and said housing body sidewalls and internal floor defining an outwardly open internal cavity.

24. A mailbox assembly according to claim 23, further comprising spring means seated in said flag housing body cavity and operatively pressuring said flag housing assembly body against said mailbox body.

25. A mailbox assembly according to claim 24, wherein said flag housing assembly further comprising a retainer member attachable to said housing body and enclosing said cavity, said retainer member and said one mailbox body said having engaging registration flange and detent recess means for retaining said flag housing assembly body in said first and said second position.

26. A mailbox assembly according to claim 25, wherein said flag housing assembly actuation means comprising a tab projection extending forward of said mailbox door member, and positioned to engage a portion of said door member as said door member is pivoted open, whereby initiating pivotal movement of said flag housing assembly body.

27. A mailbox assembly according to claim 26, wherein said flag housing tab projection extends from a lower edge of said body sidewall and is symmetrical about said flag housing body longitudinal plane of symmetry.

28. A mailbox flag assembly for pivotal attachment to a mailbox sidewall, comprising:

a flag assembly body;

attachment means extending from said assembly body to pivotally attach said body to the mailbox side;

an indicator flag means attached to said flag assembly body, said indicator flag means comprising an elongate flag stem attached at one end to said housing body and having an outwardly directed flag projection at an opposite end, said flag stem, said flag projection, and said flag housing body being symmetrical about a longitudinal plane of symmetry extending therethrough, whereby said flag body being reversible and adapted for use on either side of a mailbox at the election of a user, wherein said assembly body having actuation means responsive to pivotal opening of said mailbox door member, for pivoting said flag assembly body and said indicator flag means from a first position to a second position.

29. A mailbox flag assembly according to claim 28, wherein said actuation means being symmetrical about said plane of symmetry.

30. A mailbox flag assembly according to claim 29, wherein said actuation means comprising a tab projection extending forward of said mailbox door member, and positioned to engage a portion of said door member as said door member is pivoted open, whereby initiating pivotal movement of said flag housing assembly body.

31. A mailbox flag assembly according to claim 30, wherein said assembly further comprising spring means for constantly pressuring said body against said mailbox sidewall.

32. A mailbox flag assembly according to claim 31, wherein said housing body having sidewalls and an internal floor surface, said sidewalls and said floor surface defining an internal cavity open toward said mailbox sidewall and receiving said spring means therein;

and said assembly further comprising a retainer member attached to said housing body and enclosing said cavity.

33. A mailbox flag assembly according to claim 32, wherein said attachment means comprising a pivot post member having a head portion receivable in said housing body cavity and engaging said spring means, an intermediate shank portion, extending through an aperture in said retainer member, and flange means at a remote end for extending through an aperture in said mailbox sidewall and engaging an interior side of said mailbox sidewall, whereupon said post member pulling said spring means into a state of compression and pressuring said retainer member against said mailbox sidewall.

34. A mailbox flag assembly according to claim 33, said retainer member and said mailbox sidewall having engaging detent recess means and rib registration means for mutual engagement when said assembly is pivoted from a first to a second position.

* * * * *